US012559959B2

(12) United States Patent
Mazzo

(10) Patent No.: US 12,559,959 B2
(45) Date of Patent: Feb. 24, 2026

(54) HYDRAULIC LIFT CAISSON FOR BUILDINGS AND OTHER HEAVY AND/OR LARGE OBJECTS

(71) Applicant: Anthony J Mazzo, New York, NY (US)

(72) Inventor: Anthony J Mazzo, New York, NY (US)

( * ) Notice: Subject to any disclaimer, the term of this patent is extended or adjusted under 35 U.S.C. 154(b) by 313 days.

(21) Appl. No.: 18/489,808

(22) Filed: Oct. 18, 2023

(65) Prior Publication Data

US 2024/0401353 A1 Dec. 5, 2024

Related U.S. Application Data

(63) Continuation-in-part of application No. 18/204,565, filed on Jun. 1, 2023, now Pat. No. 11,828,076.

(51) Int. Cl.
*E04G 23/00* (2006.01)
*E04G 23/06* (2006.01)

(52) U.S. Cl.
CPC ..... *E04G 23/065* (2013.01)

(58) Field of Classification Search
CPC ..... B66F 7/00; B66F 7/08; B66F 1/04; B66F 1/00; E04G 23/065; E04G 25/06; E04G 25/006
See application file for complete search history.

(56) References Cited

U.S. PATENT DOCUMENTS

| | | | | |
|---|---|---|---|---|
| 4,765,777 | A * | 8/1988 | Gregory | E02D 35/00 405/230 |
| 11,828,076 | B1 * | 11/2023 | Mazzo | B66F 7/20 |
| 2021/0071381 | A1 * | 3/2021 | Kaufman | E02D 5/56 |
| 2024/0401353 | A1 * | 12/2024 | Mazzo | E04G 23/065 |
| 2025/0243667 | A1 * | 7/2025 | Olson | E04C 3/18 |

* cited by examiner

*Primary Examiner* — Lee D Wilson
(74) *Attorney, Agent, or Firm* — Stanzione & Associates, PLLC; Patrick Stanzione

(57) ABSTRACT

A hydraulic lift caisson for lifting buildings includes a pair of support columns fixed at first ends to a support column base plate and at second ends to an anchor plate, a lifting post disposed between the pair of support columns and fixed to a lifting post base plate, wherein the lifting post base plate slides along the pair of support columns, and a plurality of threaded lifting rods disposed between the support columns and the lifting post. The lifting post base plate slides along the pair of support columns together with the lifting post when the threaded lifting rods are lifted upward by hydraulic jacks disposed on the anchor plate.

12 Claims, 10 Drawing Sheets

HYDRAULIC LIFT CAISSON FOR BUILDINGS AND OTHER HEAVY AND/OR LARGE OBJECTS

CROSS-REFERENCE TO RELATED APPLICATIONS

The present inventive concept is a continuation-in-part (CIP) of and claims benefit of priority under 37 C.F.R. 1.121(f) to co-pending U.S. patent application Ser. No. 18/204,565, filed Jun. 1, 2023, the entire disclosure of which is hereby incorporated by reference herein.

STATEMENT REGARDING FEDERALLY SPONSORED RESEARCH OR DEVELOPMENT

Not applicable.

COPYRIGHT NOTICE

A portion of this disclosure contains material which is subject to copyright protection. The copyright owner has no objection to the photocopy reproduction by anyone of the patent document or the patent disclosure in exactly the form it appears in the Patent and Trademark Office patent file or records, but otherwise reserves all copyright rights whatsoever. 37 C.F.R 1.71(d).

BACKGROUND OF THE INVENTIVE CONCEPT

1. Field of the Invention

The present inventive concept relates to a hydraulic lift caisson to lift buildings and other large and/or heavy objects. More particularly, but not exclusively, this inventive concept relates to a hydraulic lift caisson to lift buildings off the ground or off a cellar floor to extreme heights in one continuous stroke.

Description of the Related Art

Buildings are sometimes required to be moved from one location to another or may be required to be raised due to an unstable foundation which needs to be reinforced. In these cases the building being required to be moved must first be raised off the ground before being able to be moved. However, raising and moving a building is a very complex task with great risks to the building's structure, including unrepairable damage, if not performed properly.

Conventionally raising a building has been performed with a significant number of hand jacks and manpower to raise the building in slight increments at a time. Even with this process the building often ends up being raised unevenly, causing cracks or more significant damage to the foundation of the building and to the building itself. Once a foundation of a building is damaged repairs to this foundation are extremely difficult and often impossible to achieve. Similarly, once a building's structure becomes damaged repairs to the building are extremely difficult and often impossible to achieve.

U.S. Pat. No. 9,022,355 by Pigeon is directed to a hydraulic jack attachment for quickly and safely jacking up high clearance objects. The hydraulic jack attachment includes a base support 20, a footing 30, and a linkage tube 40 interlocked with a lifting member 50 and positioned within the base support 20. A hydraulic jack 12 can be placed into a lower end 22 of the base support 20 via an access opening 23. When the jack 12 is lifted, it will force the linkage tube 40 and lifting tube 50 upwards. A lifting head 60 on the upper end 51 of the tube 50 will press against and force an object upward. This hydraulic jack attachment is not configured to lift heavy objects, such as a building, cannot provide the stability required to lift a building, and cannot be provided in plurality while simultaneously controlling each of the plurality of hydraulic jack attachments to lift such heavy objects evenly.

KR 20090006548A by Son Jang HYEOK is directed to a structure lifting device to lift a structure to the appointed height without dismantling the structure, and to regulate the lifting height of a structure easily by fixing, using a locking nut, after lifting up to the appointed height. This structure lifting device comprises a plurality of support columns 100 composed of a circular steel pipe fixed to the ground, a plurality of full thread bolts 200 inserted within the support column 100 and installed to make each end exposed to the upper part, and an end plate 300 provided with a plurality of through holes on its corners to penetrate the full thread bolts and attached to the top of the support column, and a hydraulic jack 400. This lifting device cannot lift heavy loads to great heights because it relies solely on the structural strength and stability of the plurality of the threaded rods, which are relatively slender and, thus, are not suitable to support heavy loads in compression. Also, this lifting device does not have the structural reliability to maintain a constant lifting capacity because the load carrying capacity and stability of the plurality of threaded rods in compression inherently decreases as the height of the lift increases.

Accordingly, there is a need for a lift caisson that can lift heavy buildings.

There is also a need for a lift caisson that can lift heavy buildings evenly to prevent damage to foundations and building structures to unlimited heights.

There is also a need for a lift caisson that can lift a heavy building from its foundation or from the ground.

SUMMARY OF THE INVENTIVE CONCEPT

The present general inventive concept provides a hydraulic lift caisson to lift buildings (or other large and/or heavy objects). More particularly, but not exclusively, this inventive concept relates to a hydraulic lift caisson to lift buildings off the ground or cellar floor in one continuous stroke.

Additional features and utilities of the present general inventive concept will be set forth in part in the description which follows and, in part, will be obvious from the description, or may be learned by practice of the general inventive concept.

The foregoing and/or other features and utilities of the present general inventive concept may be achieved by providing a hydraulic lift caisson to lift a building, comprising: a rigid pipe at least 10 feet in length having first and second ends; a rigid lifting post at least 10 feet in length disposed within the rigid pipe and including first and second ends; a base lifting plate having a diameter substantially the same as an inner diameter of the rigid pipe, the base lifting plate being attached to the second end of the rigid lifting post and including a plurality of symmetrical holes therethrough surrounding the rigid lifting post and configured to move along the length of the inner diameter of the rigid pipe; an anchor plate fixed to the first end of the rigid pipe and including a center cutout to receive the rigid lifting post therethrough and a plurality of symmetrical holes surrounding the cutout; a jacking plate disposed directly above the anchor plate and including a center cutout to receive the rigid lifting post therethrough and a plurality of symmetrical holes surrounding the cutout; a plurality of threaded lifting rods extending through respective ones of the holes through the base lifting plate, the anchor plate and the jacking plate, each of the threaded lifting rods including a base plate locking nut threaded onto a bottom end of each of the threaded rods to lock the bottom end of the threaded rods to the base lifting plate, an anchor plate locking nut threaded onto each of the threaded lifting rods directly above the anchor plate to cause the threaded lifting rods to hang from the anchor plate, and a jacking plate full load nut threaded to each of the threaded lifting rods to rest on a top surface of the jacking plate; and a plurality of hydraulic jacks disposed between the anchor plate and the jacking plate to lift the jacking plate away from the anchor plate, thus also lifting the threaded lift rods, base lifting plate and rigid lifting post upward together with the jacking plate.

In an exemplary embodiment, the rigid pipe, the rigid lifting post, the threaded rods, the anchor plate and the jacking plate are formed of steel.

In another exemplary embodiment, the rigid lifting post is square and the plurality of threaded lifting rods are twelve in number, wherein three threaded lifting rods are disposed adjacent to each of the four sides of the rigid lifting post.

In another exemplary embodiment, the anchor plate and the jacking plate are square and the plurality of hydraulic jacks include one hydraulic jack disposed at each corner of the anchor plate and jacking plate.

In still another exemplary embodiment, the rigid pipe is thirty-six inches in diameter and has a ½ inch thick wall.

In yet another exemplary embodiment, the rigid lifting post includes four sixteen inch sides that are each ⅝ inch thick.

In still another exemplary embodiment, the anchor plate and the jacking plate are four inches thick.

The foregoing and/or other features and utilities of the present general inventive concept may also be achieved by providing a hydraulic lift caisson to lift large heavy objects, comprising: a circular rigid pipe having first and second ends; a rigid lifting post disposed within the rigid circular pipe and including a first end extending out of the first end of the circular rigid pipe and a second end; a circular base lifting plate having a diameter substantially the same as an inner diameter of the rigid pipe, the base lifting plate being attached to the second end of the rigid lifting post and configured to move along a length of the inner diameter of the rigid circular pipe; an anchor plate fixed to the first end of the rigid circular pipe and including a center cutout to receive the rigid lifting post therethrough and a plurality of symmetrical holes surrounding the cutout; a jacking plate disposed directly above the anchor plate and including a center cutout to receive the rigid lifting post therethrough and a plurality of symmetrical holes surrounding the cutout; a plurality of threaded lifting rods each having a first end extending through respective holes in the anchor plate and jacking plate and having a second end connected to the base lifting plate, each of the threaded lifting rods including an anchor plate locking nut threaded onto the first end thereof to be disposed directly above the anchor plate to cause the threaded lifting rods to hang from the anchor plate and a jacking plate full load nut threaded onto the first end thereof to rest on a top surface of the jacking plate; and at least one hydraulic jack disposed between the anchor plate and the jacking plate to lift the jacking plate away from the anchor plate, thus also lifting the threaded lift rods, the base lifting plate and the rigid lifting post upward together with the jacking plate.

In an exemplary embodiment, the circular rigid pipe and the rigid lifting post are formed in ten feet increments and can be attached to another one of the circular rigid pipes and rigid lifting posts, respectively, to form a single twenty foot circular rigid pipe and a single twenty foot lifting post.

The foregoing and/or other features and utilities of the present general inventive concept may also be achieved by providing a hydraulic lift caisson to lift a building, comprising: at least two support columns including first and second ends; a lifting post disposed between the support columns and including first and second ends, wherein the second end is configured to be placed directly under a building or other large object to be lifted; a support column base plate attached to the first end of each support column; a lifting post base plate disposed above the support column base plate, the lifting post base plate having a first end of the lifting post fixed to a top surface thereof and including: at least two support column holes to receive a corresponding one of the support columns therethrough; and at least two rod holes each to receive a threaded rod therethrough; an anchor plate fixed to the second ends of the pair of support columns, the anchor plate including: a lifting post hole to receive the lifting post therethrough, and at least two rod holes each to receive a threaded rod therethrough; a jacking plate disposed directly above the anchor plate and including: a center hole to receive the lifting post therethrough; and at least two rod holes each to receive a threaded rod therethrough; at least two threaded lifting rods extending through respective ones of the rod holes through the lifting post base plate, the anchor plate and the jacking plate, each of the threaded rods including a lifting post base plate locking nut threaded onto a first end thereof to lock a first end of the threaded lifting rods between the support column base plate and the lifting post base plate, an anchor plate nut threaded onto each of the threaded lifting rods and disposed between the anchor plate and the jack plate, and a jacking plate nut threaded onto each of second ends of the threaded lifting rods to rest on a top surface of the jacking plate; and a plurality of hydraulic jacks disposed between the anchor plate and the jacking plate to lift the jacking plate away from the anchor plate, thus also lifting the threaded lifting rods, the lifting post base plate and the lifting post upward together with the jacking plate.

In an exemplary embodiment, the at least two support columns, the lifting post, the threaded rods, the anchor plate and the jacking plate can be formed of steel.

In another exemplary embodiment, the support column base plate, the lifting post base plate, the anchor plate and the jack plate can be rectangular, and the lifting post can be square.

In another exemplary embodiment, the at least two rod holes formed through the lifting post base plate, the anchor plate and the jack plate include four holes; and the at least two threaded lifting rods can include four threaded lifting rods.

In still another exemplary embodiment, the plurality of hydraulic jacks can include one hydraulic jack disposed above each of the at least two support columns and between the anchor plate and the jack plate.

In still another exemplary embodiment, the lifting post can include four sixteen inch sides that are each ⅝ inch thick.

In yet another exemplary embodiment, the anchor plate and the jacking plate can be four inches thick.

In yet another exemplary embodiment, the at least two support columns and the lifting post can be at least 10 feet in length.

The foregoing and/or other features and utilities of the present general inventive concept may also be achieved by providing a hydraulic lift caisson to lift large heavy objects, comprising: a support column base plate including two parallel support columns fixed at first ends thereof to a top surface of the support column base plate; a lifting post base plate disposed directly above the support column base plate, the lifting post base plate including: two support column holes each to receive a respective one of the support columns therethrough; a lifting post extending from a top surface thereof and disposed between the two support column holes; and first and second pairs of rod holes extending therethrough, the first pair of rod holes disposed between one support column and the lifting post and the second pair of rod holes disposed between the other support column and the lifting post; an anchor plate fixed to second ends of the two support columns, the anchor plate including: a lifting post hole to receive the lifting post therethrough, and first and second pairs of rod holes axially aligned with the first and second pairs of rod holes extending through the lifting post base plate; a jacking plate disposed directly above the anchor plate and including: a center hole to receive the lifting post therethrough; and two pairs of rod holes axially aligned with the first and second pairs of rod holes extending through the lifting post base plate and the anchor plate; two pairs of threaded lifting rods extending through each of the two pairs of rod holes extending through the lifting post base plate, the anchor plate and the jacking plate, each of the threaded rods including a lifting post base plate locking nut threaded onto a first end thereof to lock a first end of the threaded lifting rods between the support column base plate and the lifting post base plate, an anchor plate nut threaded onto each of the threaded lifting rods between the anchor plate and the jack plate, and a jacking plate nut threaded onto each of second ends of the threaded lifting rods to rest on a top surface of the jacking plate; and at least one hydraulic jack disposed between the anchor plate and the jacking plate to lift the jacking plate away from the anchor plate, thus also lifting the threaded lifting rods, the lifting post base plate and the lifting post upward together.

In an exemplary embodiment, the two support columns, the lifting post, the threaded rods, the anchor plate and the jacking plate can be formed of steel.

In another exemplary embodiment, the support column base plate, the lifting post base plate, the anchor plate and the jack plate can be rectangular, and the lifting post can be square.

In still another exemplary embodiment, the at least one hydraulic jack can include one hydraulic jack disposed at each of two sides of the lifting post.

BRIEF DESCRIPTION OF THE DRAWINGS

These and/or other features and utilities of the present inventive concept will become apparent and more readily appreciated from the following description of the embodiments, taken in conjunction with the accompanying drawings of which.

Figure 1:
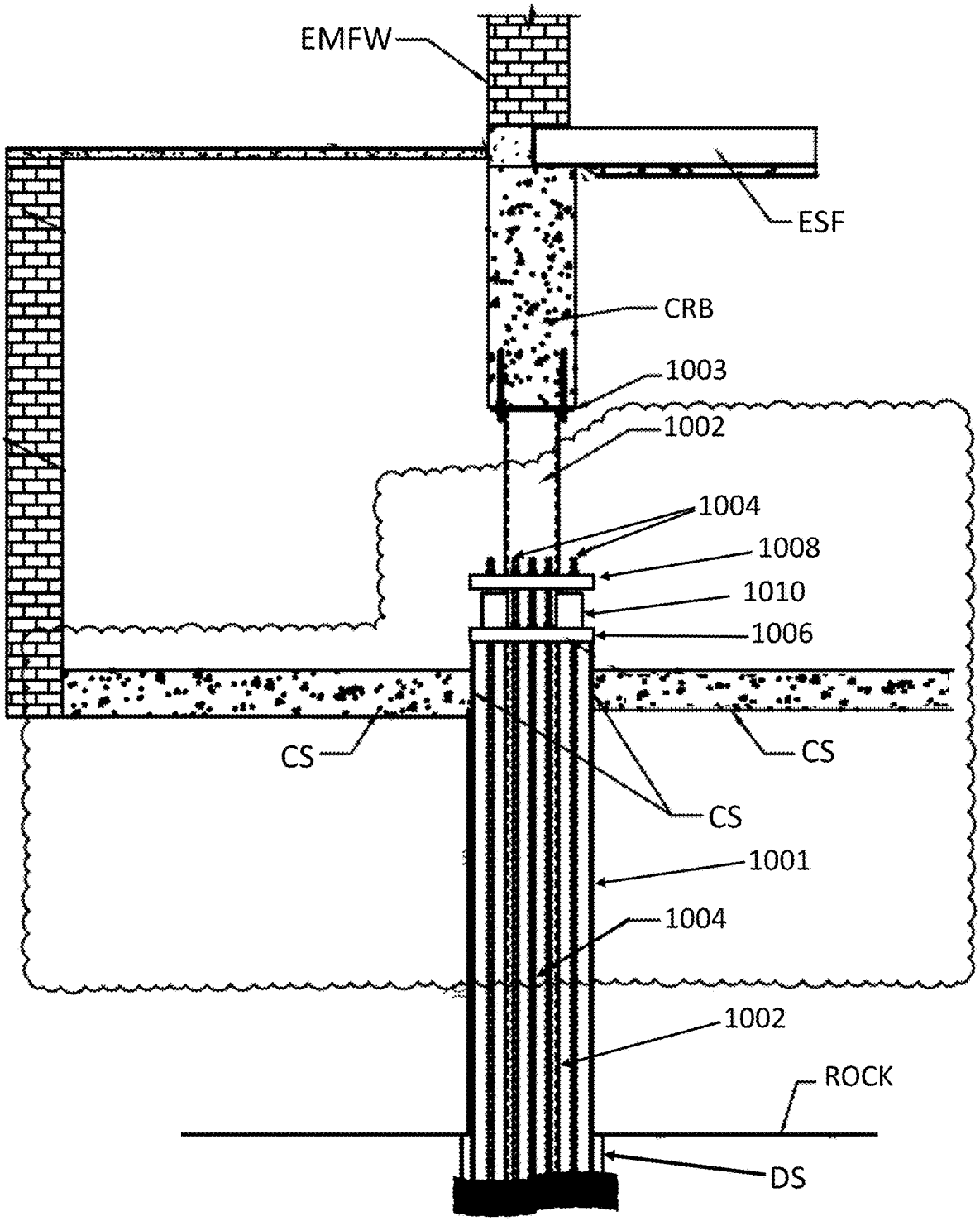
FIG. 1 illustrates a plan view of a hydraulic lift caisson according to an example embodiment of the present inventive concept.

The drawings illustrate a few exemplary embodiments of the present inventive concept, and are not to be considered limiting in its scope, as the overall inventive concept may admit to other equally effective embodiments. The elements and features shown in the drawings are to scale and attempt to clearly illustrate the principles of exemplary embodiments of the present inventive concept. In the drawings, reference numerals designate like or corresponding, but not necessarily identical, elements throughout the several views.

DETAILED DESCRIPTION OF THE PREFERRED EMBODIMENTS

Reference will now be made in detail to the embodiments of the present general inventive concept, examples of which are illustrated in the accompanying drawings, wherein like reference numerals refer to the like elements throughout. The embodiments are described below in order to explain the present general inventive concept while referring to the figures. Also, while describing the present general inventive concept, detailed descriptions about related well-known functions or configurations that may diminish the clarity of the points of the present general inventive concept are omitted.

It will be understood that although the terms "first" and "second" are used herein to describe various elements, these elements should not be limited by these terms. These terms are only used to distinguish one element from another element. Thus, a first element could be termed a second element, and similarly, a second element may be termed a first element without departing from the teachings of this disclosure.

Expressions such as "at least one of," when preceding a list of elements, modify the entire list of elements and do not modify the individual elements of the list.

All terms including descriptive or technical terms which are used herein should be construed as having meanings that are obvious to one of ordinary skill in the art. However, the terms may have different meanings according to an intention of one of ordinary skill in the art, case precedents, or the appearance of new technologies. Also, some terms may be arbitrarily selected by the applicant, and in this case, the meaning of the selected terms will be described in detail in the detailed description of the invention. Thus, the terms used herein must be defined based on the meaning of the terms together with the description throughout the specification.

Also, when a part "includes" or "comprises" an element, unless there is a particular description contrary thereto, the part can further include other elements, not excluding the other elements.

Hereinafter, one or more exemplary embodiments of the present general inventive concept will be described in detail with reference to accompanying drawings.

Exemplary embodiments of the present general inventive concept are directed to a hydraulic lift caisson to lift buildings (or other large and/or heavy objects). More particularly, but not exclusively, this inventive concept relates to a hydraulic lift caisson to lift buildings off the ground or a cellar floor in which such buildings are built on. The exemplary embodiments will be described in detail below with reference to FIG. 1 through FIG. 6.

FIG. 1 illustrates a plan view of a hydraulic lift caisson 1000 according to an exemplary embodiment of the present inventive concept. Referring to FIG. 1, a hydraulic lift caisson 1000 can include an outer pipe 1001 as a main body. The outer pipe 1001 can be formed of steel, or any other metal material that will withstand tons of weight. For consistency the outer pipe 1001 will be referred to as an outer steel pipe 1001. The outer steel pipe 1001 is preferably 36 inches in diameter and can have a wall thickness of ½ inch. The outer steel pipe 1001 can be provided in 10 feet sections or can be formed as one single piece to a desired length. The desired length of the outer steel pipe 1001 will depend on how deep the requirement will be to insert the outer steel pipe 1001 into the ground in order to rest a bottom end thereof securely on solid rock underground while a top end thereof extends up past the ground level in which a building rests. Alternatively, the outer steel pipe 1001 can have a different diameter and wall thickness depending on the size and weight of a building intended to be lifted. A plurality of outer steel pipes 1001 can be connected together to provide one elongated outer steel pipe 1001, as will be described in more detail below.

Within the outer steel pipe 1001 can be provided a steel lifting post 1002. The steel lifting post 1002 preferably extends the entire length of the outer steel pipe 1001 and is preferably formed to be 16 inches by 16 inches square, with a wall thickness of ⅝ inch. The steel lifting post 1002 can be provided in 10 feet sections or can be formed as one single piece to a desired length. The desired length of the steel lifting post 1002 will depend on how deep the requirement will be to insert the steel lifting post 1002, within the outer steel pipe 1001, into the ground in order to rest the bottom end of the outer steel pipe 1001 securely on solid rock underground while a top end extends up past the ground level in which a building rests. A plurality of steel lifting posts 1002 can be connected together to provide one elongated steel lifting post 1002, as will be described in more detail below. Alternatively, the steel lifting post 1002 can have a different area and wall thickness depending on the size and weight of a building to be lifted. Also, the steel lifting post 1002 can be formed of alternative types of metals which will withstand several tons of weight. The steel lifting post 1002 is preferably disposed to extend along the inner center of the outer steel pipe 1001. The steel lifting post 1002 preferably includes a top lifting plate 1003 formed at a first (top) end thereof, which is configured to extend out through the first (top) end of the outer steel pipe 1001 when the hydraulic lift caisson 1000 is in operation, as will be described in more detail below.

The outer steel pipe 1001 can also include a plurality of threaded lifting rods 1004 disposed therein and extending along the entire length therein. The threaded lifting rods 1004 are preferably disposed to surround the steel lifting post 1002 and are preferably also formed of steel. The threaded lifting rods 1004 can alternatively be formed of another type of metal which will withstand the weight of several tons. According to an example embodiment, the plurality of threaded lifting rods 1004 can include twelve threaded lifting rods 1004. Alternatively, the threaded lifting rods 1004 can be provided in a certain number depending on the size and weight of a building to be lifted by the hydraulic lift system 1000.

Figure 4:
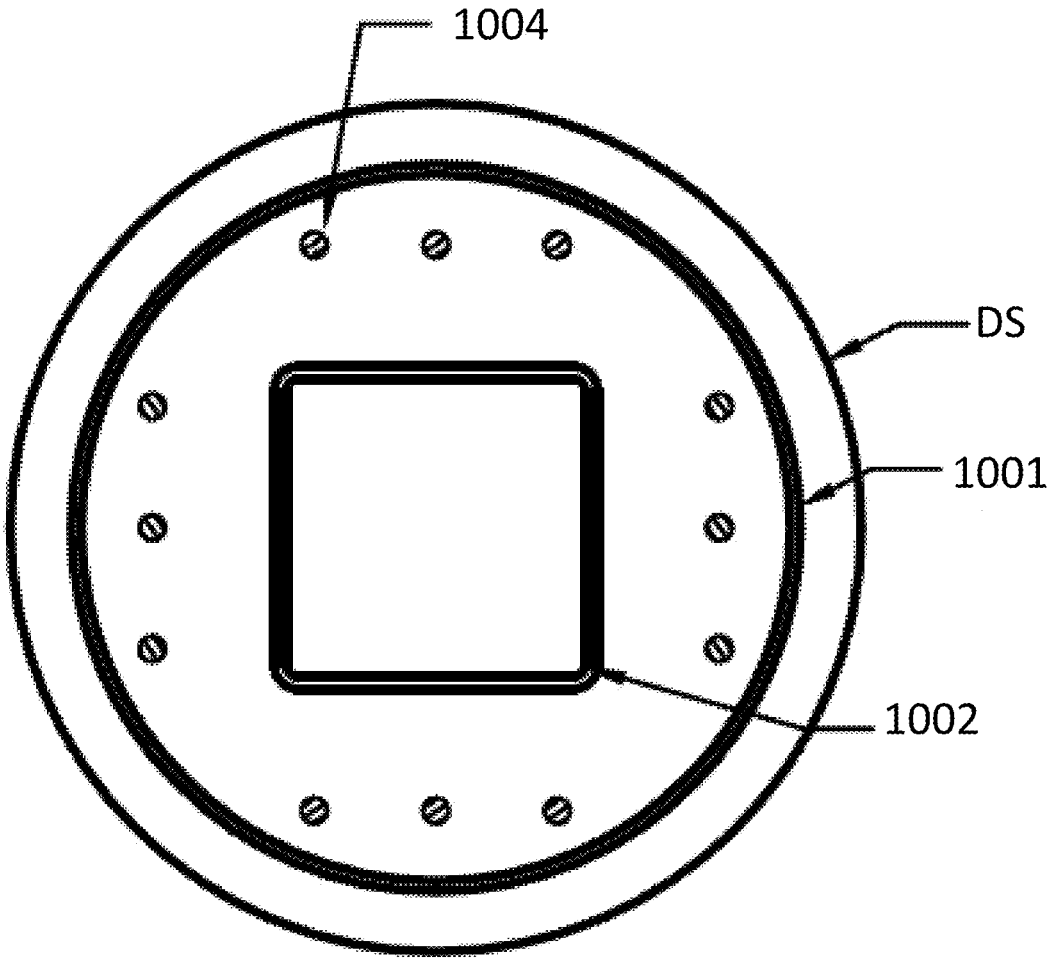
FIG. 4 illustrates a bottom view extending along a length of the hydraulic lift caisson as illustrated in FIG. 1.

FIG. 4 illustrates a top view of the hydraulic lift caisson 1000 according to an example embodiment of the present inventive concept. As illustrated in FIG. 4, the outer steel pipe 1001 includes the steel lifting post 1002 disposed along the center therein and twelve threaded lifting rods 1004 surrounding the steel lifting post 1002, wherein three threaded lifting rods 1004 can be disposed adjacent to each of four sides of the steel lifting post 1002. The outer steel pipe 1001 is configured to be insertable into a drilled shaft DS, which can be pre-drilled down into the ground beneath a building intended to be lifted. Once the drilled shaft DS is formed by drilling into the ground the outer steel pipe 1001, including the steel lifting post 1002 and threaded lifting rods 1004, can be inserted therein until the first (top) end of the outer steel pipe 1001 is positioned under a concrete ring beam CRB disposed beneath a building, as illustrated in FIG. 1, or positioned under a foundation of the building which is to be lifted together with the building. The hydraulic lift caisson 1000 can be positioned under any portion of a building which is sufficiently secure enough to remain intact when being lifted by a plurality of the hydraulic lift caissons 1000.

Figure 2:
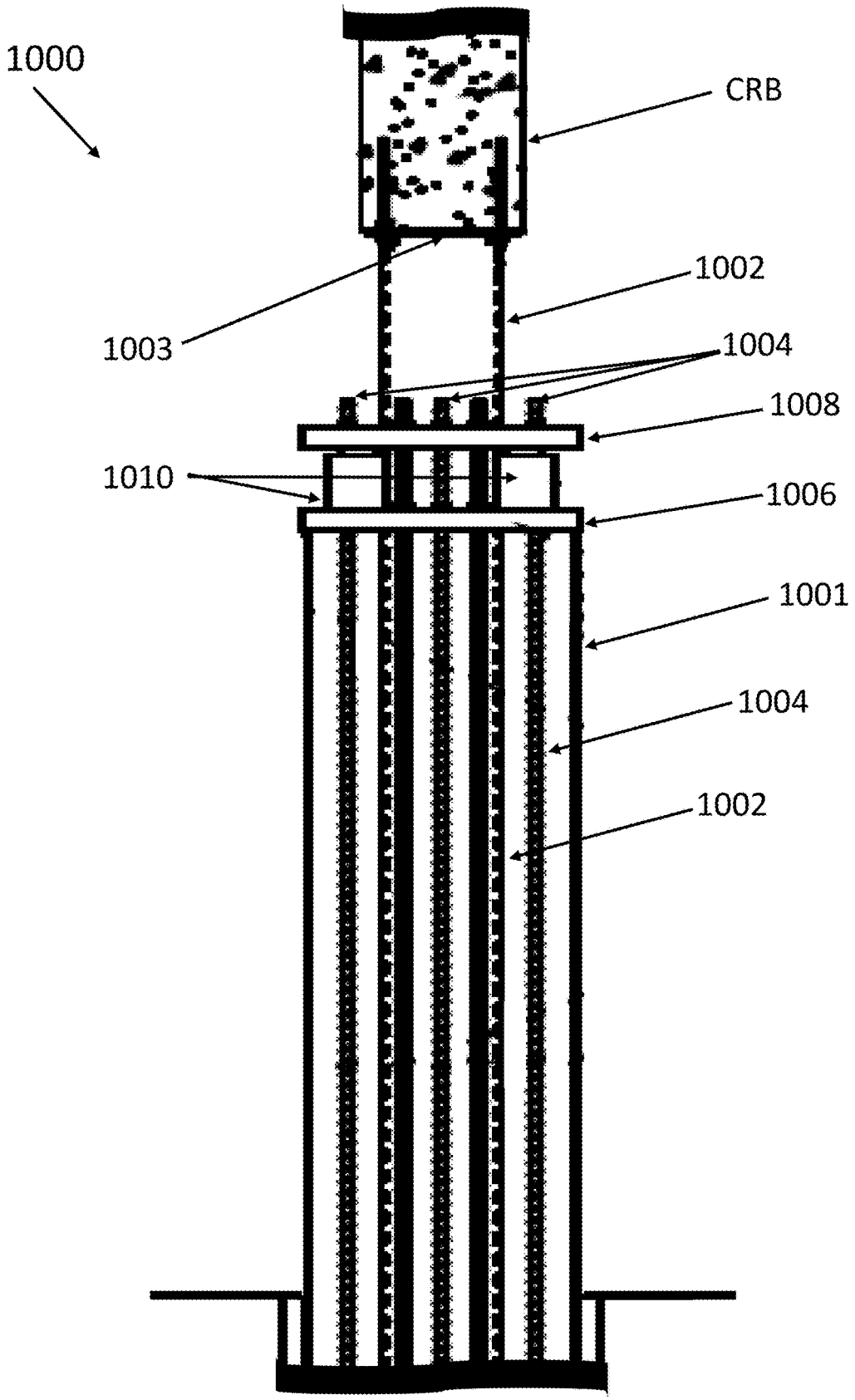
FIG. 2 illustrates an expanded plan view of an upper portion of the hydraulic lift caisson as illustrated in FIG. 1.
Figure 5:
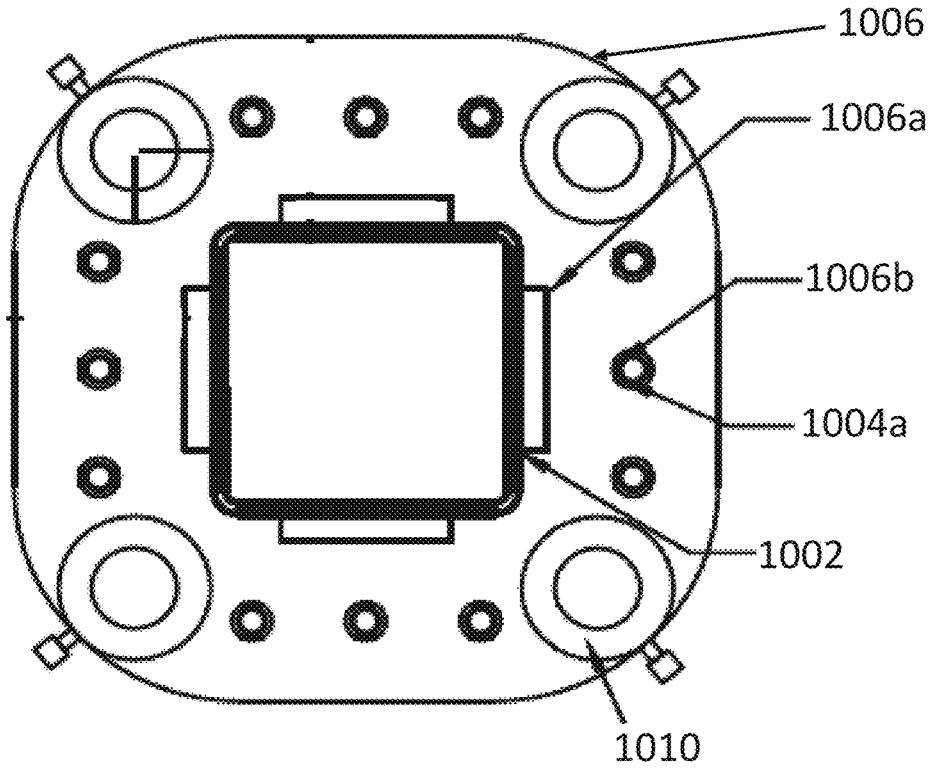
FIG. 5 illustrates a top view of an anchor plate and jack assembly of the hydraulic lift caisson as illustrated in FIG. 1.

FIG. 2 illustrates an expanded plan view of an upper portion of the hydraulic lift caisson 1000 as illustrated in FIG. 1. Referring to FIG. 2, at the first (top) end of the outer steel pipe 1001 can be disposed an anchor (or locking) plate 1006. The anchor plate 1006 can be formed of steel, or any other metal which will perform the intended purposes as described herein without departing from the spirit and scope of the present inventive concept. The anchor plate 1006 can be formed to be 4 inches in thickness and can have a diameter slightly larger than the diameter of the outer steel pipe 1001. Alternatively, the anchor plate 1006 can be formed in a square shape with smoothed or rounded corners, as illustrated in FIG. 5. The anchor plate 1006 is preferably configured to be fixedly secured to the first (top) end of the outer steel pipe 1001. In an example embodiment the anchor plate 1006 can be welded to the first end of the outer steel pipe 1001. The anchor plate 1006 can alternatively be formed as a closed end of the outer steel pipe 1001, acting as a cap of the outer steel pipe 1001. The anchor plate 1006 also can include a centrally located cutout **1006*a* for the steel lift post 1002 to extend therethrough and a plurality of holes 1006*b* symmetrically located to surround the cutout 1006*a* and configured to receive respective ones of the plurality of threaded lifting rods 1004 to extend therethrough. The anchor plate 1006 will be described in more detail below with reference to FIG. 5**.

Referring to FIG. 5, as pointed out above, the anchor plate 1006 can include the centrally located square cutout **1006*a* to receive the steel lifting post 1002 therethrough and the plurality of symmetrically located holes 1006*b* surrounding the cutout 1006*a* to receive first ends of respective threaded lifting rods 1004 therethrough. Once the first ends of the plurality of threaded lifting rods 1004 are freely inserted through the holes 1006***b* an anchor plate locking nut 1004*a* can be threaded onto each of the respective first ends of the threaded lifting rods 1004. The anchor plate locking nuts 1004*a* are provided to rest on the top surface of the anchor plate 1006 after being threaded onto the threaded lifting rods 1004 to "hang" the threaded lifting rods 1004 and steel lifting post 1002 from the anchor plate 1006 and the first (top) end of the outer steel pipe 1001, thus preventing the threaded lifting rods 1004 from dropping down into the outer steel pipe 1001 further than the anchor plate locking nuts 1004*a* will allow.

At each of the four corners of the anchor plate 1006 can be disposed a hydraulic jack 1010, which is described in more detail below. A combined total hydraulic jacking capacity of the four hydraulic jacks is greater than the total weight of the load to be lifted. In an example embodiment of the present inventive concept, each of the hydraulic jacks 1010 can be configured to lift 150 tons of weight. Alternatively, the hydraulic jacks 1010 can be configured to lift an amount of weight that is greater than the building intended to be lifted.

Figure 3:
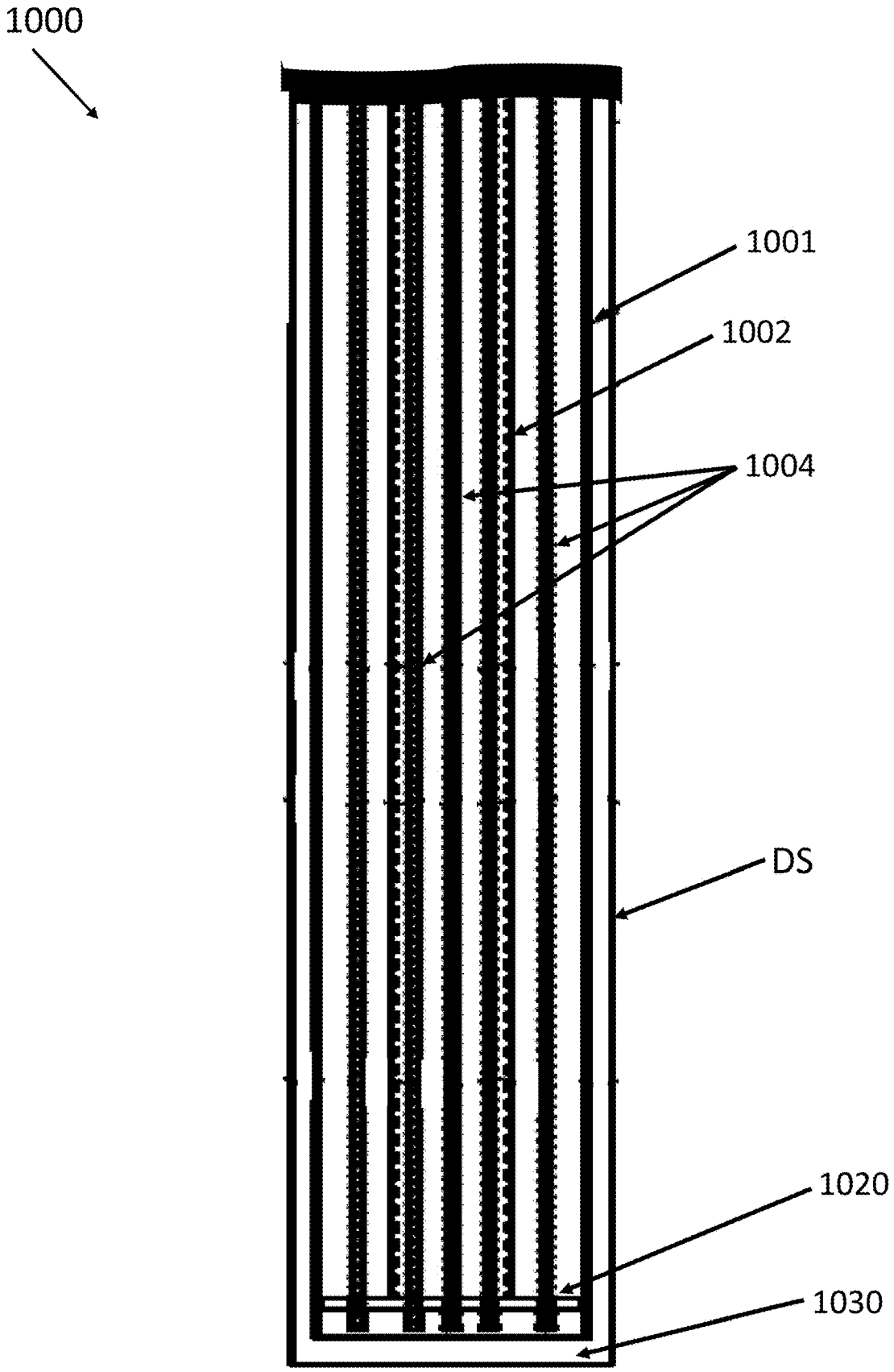
FIG. 3 illustrates an expanded plan view of a bottom portion of the hydraulic lift caisson as illustrated in FIG. 1.

FIG. 3 illustrates a lower section of the hydraulic lift caisson 1000 as illustrated in FIG. 1. Referring to FIG. 3, at a second (bottom) end of the outer steel pipe 1001 can be disposed a base lifting plate 1020. The base lifting plate 1020 is configured to be circular like the outer steel pipe 1002 and to have a diameter equal to or slightly less than the inside diameter of the outer steel pipe 1001 so as to be movable along the length of the inside of the outer steel pipe 1001. The base lifting plate 1020 is also preferably welded to the second (bottom) end of the steel lifting post 1002. The base lifting plate 1020 can include a plurality of drilled holes 1020*a* symmetrically located around the square shaped steel lifting post 1002 such that second (bottom) ends of respective ones of the plurality of threaded lifting rods 1004 can be inserted therethrough. After the second ends of the threaded lifting rods 1004 are inserted through the respective holes 1020*a* in the base lifting plate 1020 a base plate locking nut 1004*c* can be threaded onto respective ones of the second ends of the threaded lifting rods 1004 to secure the second ends of the threaded lifting rods 1004 to the base lifting plate 1020. At the center of the base lifting plate 1020 is fixed the second (bottom) end of the steel lifting post 1002 such that when the threaded lifting rods 1004 are lifted upward along the length of the outer steel pipe 1001 and extend out of the outer steel pipe 1001 the base lifting plate 1020 is also lifted upward along the inner length of the outer steel pipe 1001, which in turn will lift the steel lifting post 1002 upward along the length of the outer steel pipe 1001. At the bottom of the outer steel pipe 1001 can be welded a bottom solid plate 1030 to seal the bottom end of the outer steel pipe 1001.

Figure 6:
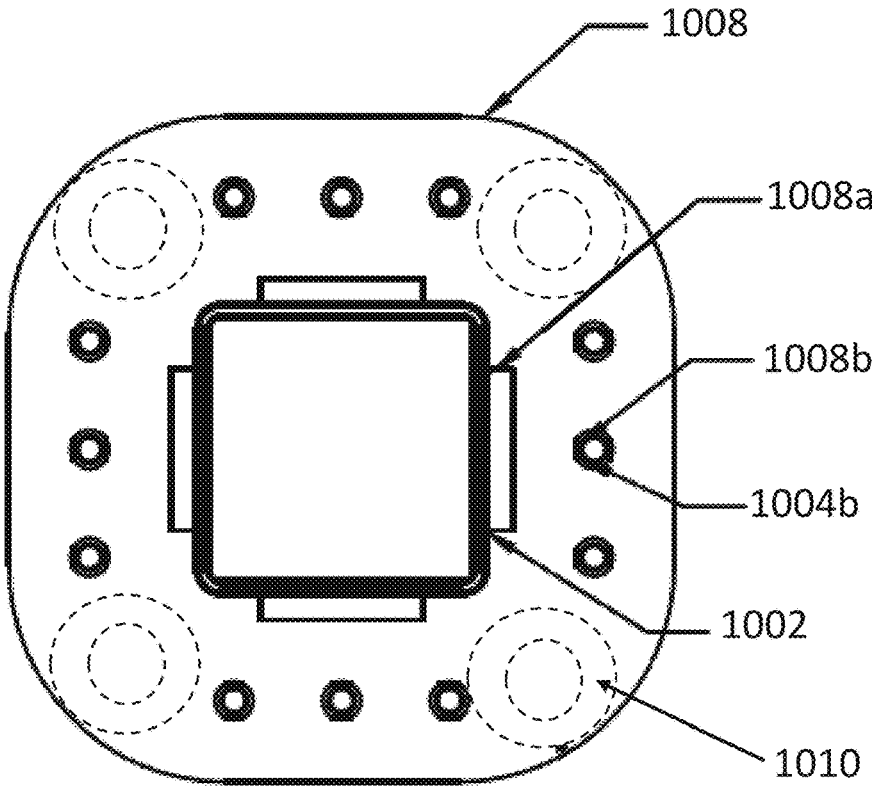
FIG. 6 illustrates a top view of a jack plate of the hydraulic lift caisson as illustrated in FIG. 1.

Referring to FIG. 2 and FIG. 6, a jacking plate 1008 can be disposed directly above the anchor plate 1006 such that the hydraulic jacks 1010 are disposed between the anchor plate 1006 and the jacking plate 1008. The jacking plate 1008 preferably has the same dimensions as the anchor plate 1006 and can include a centrally located cutout 1008*a* to receive the steel lifting post 1002 therethrough similar to the anchor plate 1006. The jacking plate 1008 can also include a plurality of symmetrically located holes 1008*b* surrounding the cutout 1008*a* to receive first ends of the threaded lifting rods 1004 therethrough, similar to the anchor plate 1006.

After the first ends of the threaded lifting rods 1004 are inserted through the respective holes 1006*b* in the jacking plate 1008 a respective jacking plate full load nut 1004*b* can be threaded thereon to force the threaded lifting rods 1004 to be lifted when the jacking plate 1008 is lifted by the hydraulic jacks 1010. With this configuration when the hydraulic jacks 1010, which are resting on the top surface of the anchor plate 1006, lift the jacking plate 1008, the threaded lifting rods 1004 will be lifted upward together with the jacking plate 1008, which will in turn also raise the anchor plate locking nuts 1004*a* upward away from the anchor plate 1006.

The hydraulic jacks 1010 disposed on each anchor plate 1006 are configured to be operated in sync to simultaneously lift the four corners of the jacking plate 1008 such that the jacking plate 1008 remains in a horizontal position while being lifted. The hydraulic jacks 1010 preferably lift the jacking plate 1008 slowly and in approximately four inch increments. After the hydraulic jacks 1010 simultaneously lift the jacking plate 1008 by approximately four inches, which will cause the threaded lifting rods 1004 to be lifted upward by approximately four inches, which will in turn cause the base lifting plate 1020 and steel lifting post 1002 to be lifted together by the same four inches, the anchor plate locking nuts 1004*a* will also be raised off the anchor plate 1006 by the same four inches. Once the anchor plate locking nuts 1004*a* have been raised by four inches away from the anchor plate 1006 the anchor plate locking nuts 1004*a* can be threaded downward until each of the anchor plate locking nuts 1004*a* is once again resting on the top surface of the anchor plate 1006. At this point the steel lifting post 1002 will have been securely lifted upward with respect to the outer steel pipe 1001 and will remain in this position since the anchor plate locking nuts 1004*a* will be securely seated on the anchor plate 1006, thus preventing the threaded lifting rods 1004 from sliding downward due to the weight of the building or other heavy object being lifted. At this point the hydraulic jacks 1010 can be simultaneously retracted back to their starting positions, which will cause the jacking plate 1008 to be lowered to its original position. Once the jacking plate 1008 is lowered back to its original position the jacking plate full load nuts 1004*b* can be threaded downward until they are again resting on the top of the jacking plate 1008. This sequence of operations can be continuously repeated until the building is lifted to the desired height.

As pointed out above, the hydraulic jacks 1010 can continue to lift the jacking plate 1008 upward by approximately four inches at a time, which will in turn lift the steel lifting post 1002 upward by an equal amount. As a result of the hydraulic jacks 1010 continually lifting the jacking plate 1008, the threaded lifting rods 1004, the base lifting plate 1020 and the steel lifting post 1002 simultaneously by approximately four inches, and then threading the anchor plate locking nuts 1004*a* back down onto the surface of the anchor plate 1006, and then retracting the hydraulic jacks 1010 back to their resting position, and then threading the jacking plate full load nuts 1004*b* back down onto the surface of the jacking plate 1008, and then repeating these steps, the building, which will be sitting on a plurality of top lifting plates 1003 welded to the first (top) end of the steel lifting posts 1002, will continue to be lifted away from the ground until the desired height is achieved.

Figure 7:
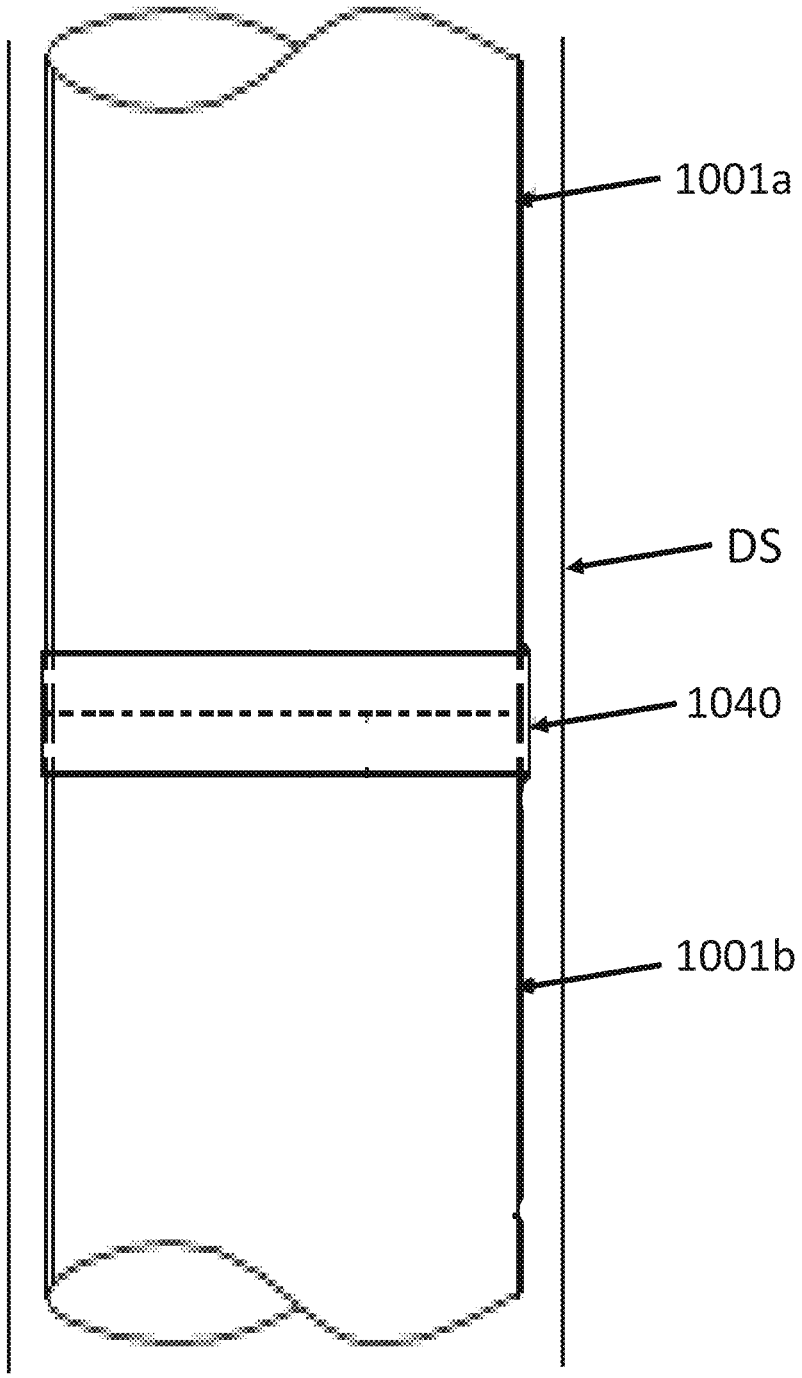
FIG. 7 illustrates two out pipes of a hydraulic lift caisson being connected together, according to an example embodiment of the present inventive concept.

FIG. 7 illustrates a case where two or more outer steel pipes 1001*a* and 1001*b* can be connected together by welding a steel ring 1040 to ends of the outer steel pipes 1001*a* and 1001*b*. Welding two or more outer steel pipes 1001 together can be performed when there is limited headroom below a building and bedrock is a long distance below ground surface. It is to be noted that alternative equivalent methods can be used to securely connect two outer steel pipes 1001 together without departing from the spirit and scope of the overall inventive concept.

Figure 8:
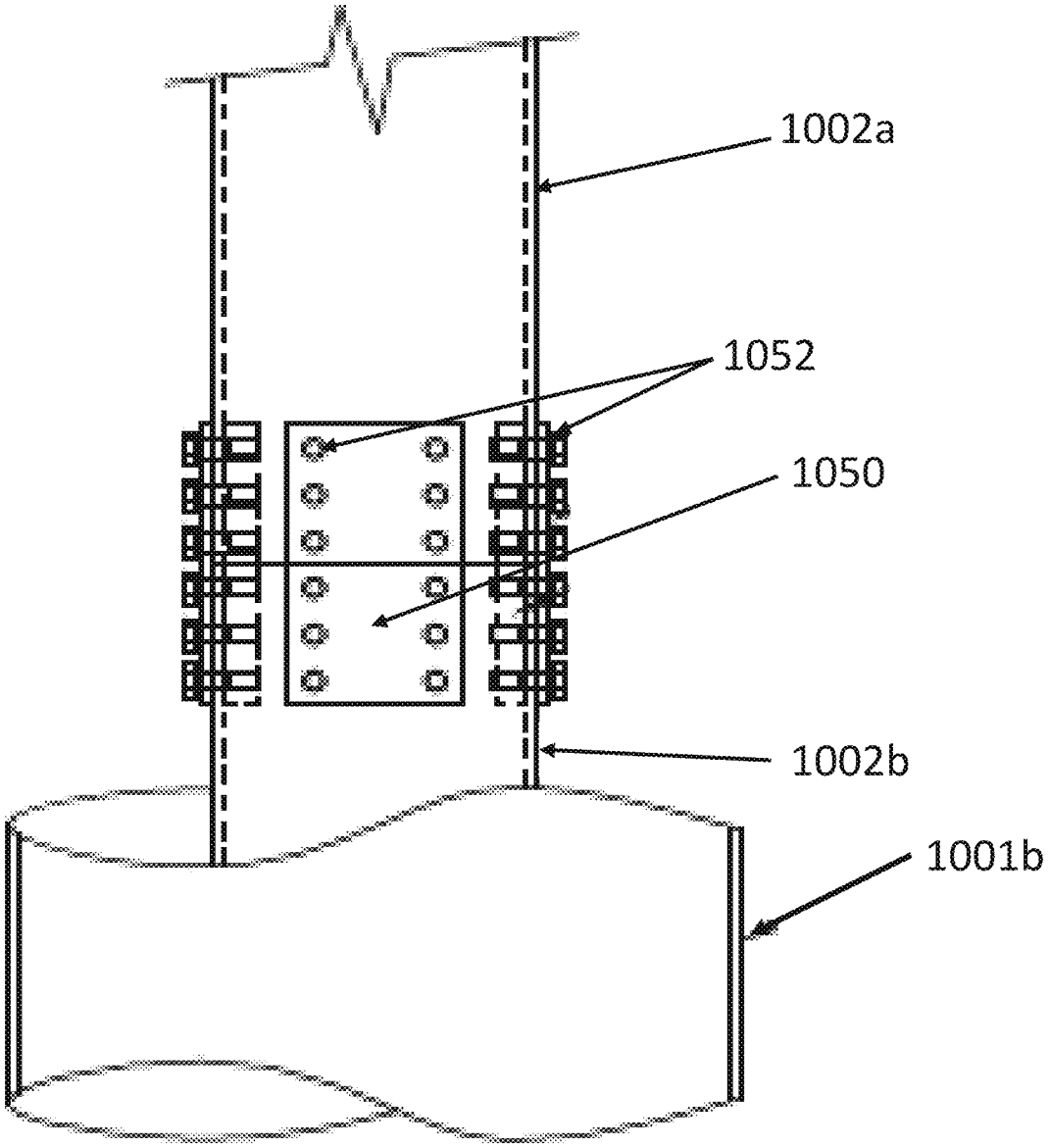
FIG. 8 illustrates two out steel lifting posts of a hydraulic lift caisson being connected together, according to an example embodiment of the present inventive concept.

FIG. 8 illustrates where two or more steel lifting posts 1002*a* and 1002*b* can be connected together when two or more corresponding outer steel pipes 1001 are being used. In this case steel splice plates 1050 can be used to bolt a first steel lifting post 1002*a* to a second steel lifting post 1002*b*. Opposing ends of each side of the first and second steel lifting posts 1002*a* and 1002*b* can have holes drilled therethrough and the steel splice plate 1050 can have a plurality of holes extending along two opposing ends thereof to correspond with the holes drilled through the opposing ends of the first and second steel lifting posts 1002*a* so that each of the four sides of the opposing ends of the steel lifting posts 1002*a* and 1002*b* can be screwed or bolted together using hex cap screws 1052. It is to be noted that alternative equivalent methods can be used to securely connect two steel lifting posts 1002 together without departing from the spirit and scope of the overall inventive concept.

Figure 9:
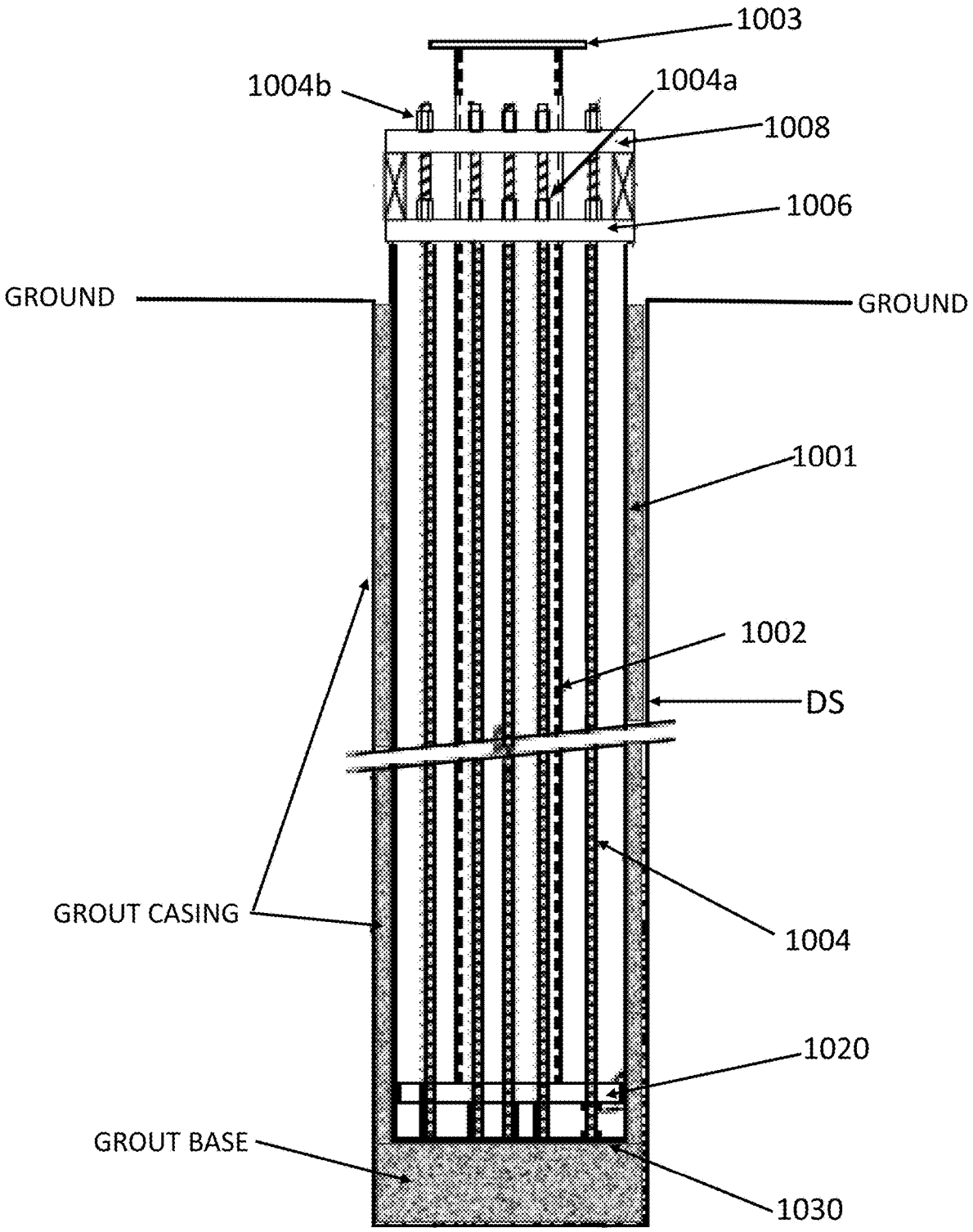
FIG. 9 illustrates the hydraulic lift caisson of FIG. 1 fully installed into the ground.

FIG. 9 illustrates the hydraulic lift caisson 1000 in the position of being fully installed into the ground below the building to be lifted. First, each drill shaft DS should be drilled down to the level such that the top portion of the hydraulic lift caisson 1000 is above the top ground surface or top rock. A grout (or cement) base should then be poured into the drill shaft DS to form a solid base for the hydraulic lift caisson 1000. Then a grout (or cement) casing should be poured around the lower portion of the hydraulic lift caisson 1000 up to approximately the ground level, as illustrated. The grout base and grout casing will provide unique characteristics of achieving very high load lifting capacities for long lift heights. The depth and wall thickness of the outer steel pipe 1001 will be a function of the total carrying capacity required and the soil characteristics by which the hydraulic lift caisson 1000 will be embedded and grouted into the soil/rock. To achieve the desired lifting height of the building to be lifted the length of the hydraulic lift caisson 1000 should be approximately two feet longer than the proposed lift height in order to ensure that there is ample height within the outer steel pipe 1001 for base lifting plate 1020 to rise within the height of the outer steel pipe 1001 and not make contact with the anchor plate 1006 before the final lift height is achieved. Similarly, the square steel lifting post 1002 should be sized to support the total load carrying capacity as well as the "unbraced length" resulting from a projected height of the square steel lifting post 1002, as measured from the top of the anchor plate 1006 to the top of the top plate 1003. In other words, the length of the square steel lifting post 1002 should be equal to the vertical distance from the top of the base lifting plate 1020 to a minimum of one foot above the top of the jacking plate 1008.

Operations of the hydraulic lift caisson 1000 according to an example embodiment of the present inventive concept will now be described in detail below.

Referring back to FIG. 1, a building generally includes an existing masonry foundation wall (EMFW). This EMFW is intended to remain with a building when the building is intended to be lifted. Such buildings generally also include an existing steel framing (ESF) as a bottom surface of the building. Below the existing steel framing ESF is generally disposed a plurality of concrete ring beams CRBs which rest on a concrete slab CS. A plurality of drill shafts DS can be first drilled downward through the concrete slab CS and into the ground below. Then a grout (or cement) base can be poured to create a solid foundation for the hydraulic lift caisson 1000 to securely rest on. Once the hydraulic lift caisson 1000 is dropped down into the drill shaft DS and standing vertically a grout (or cement) casing can be poured around the lower section of the hydraulic lift caisson 1000 to secure the hydraulic lift caisson 1000 in place and in an upright position. The drill shafts DS can be drilled down to a depth such that when the outer steel pipe 1001 is inserted into a respective DS the first (top) end of the outer steel pipe 1001 and the first (top) end of the steel lifting post 1002 can be slid under a respective concrete ring beam CRB. At this point the top lifting plate 1003 will be disposed directly under the respective CRB and the hydraulic lift caisson 1000 is in a vertical position to pour the grout casing. According to an example embodiment the top lifting plate 1003 can be bolted to a bottom surface of the CRB to ensure that the outer steel pipe 1001 and steel lifting post 1002 remain in alignment with the CRB while the grout casing dries around the outer steel pipe 1001.

A hydraulic lift caisson 1000 can be positioned under each of the CRBs used under the intended building to be lifted. Once each of the CRBs has a hydraulic lift caisson 1000 disposed thereunder, the hydraulic jacks 1010 used with each of the plurality of hydraulic lift caissons 1000 can be activated simultaneously to lift their respective jacking plates 1008 in unison by approximately four inches, which will cause the threaded lifting rods 1004 and respective steel lifting posts 1002 to lift the respective CRBs upward, thus lifting the building upward evenly. Each time the four hydraulic jacks 1010 for each of plurality of hydraulic lift caissons 1000 lifts the corresponding jacking plate 1008 up by approximately four inches, the anchor plate locking nuts 1004*a* can be threaded downward along the corresponding threaded lifting rod until the anchor plate locking nuts 1004*a* are again resting on the top of the anchor plate 1006. Then the hydraulic jacks 1010 can be retracted to their original position causing the jacking plates 1008 to be lowered back to their original position. Then the jacking plate full load nuts 1004*b* can be threaded downward to once again rest on the top surface of the jacking plate 1008. This sequence of operations can be continuously repeated until the building being lifted is raised to a desired height for the intended purpose. Moreover, the building being lifted by the plurality of hydraulic lift caissons 1000 will be evenly lifted in one continuous stroke.

Figure 10:
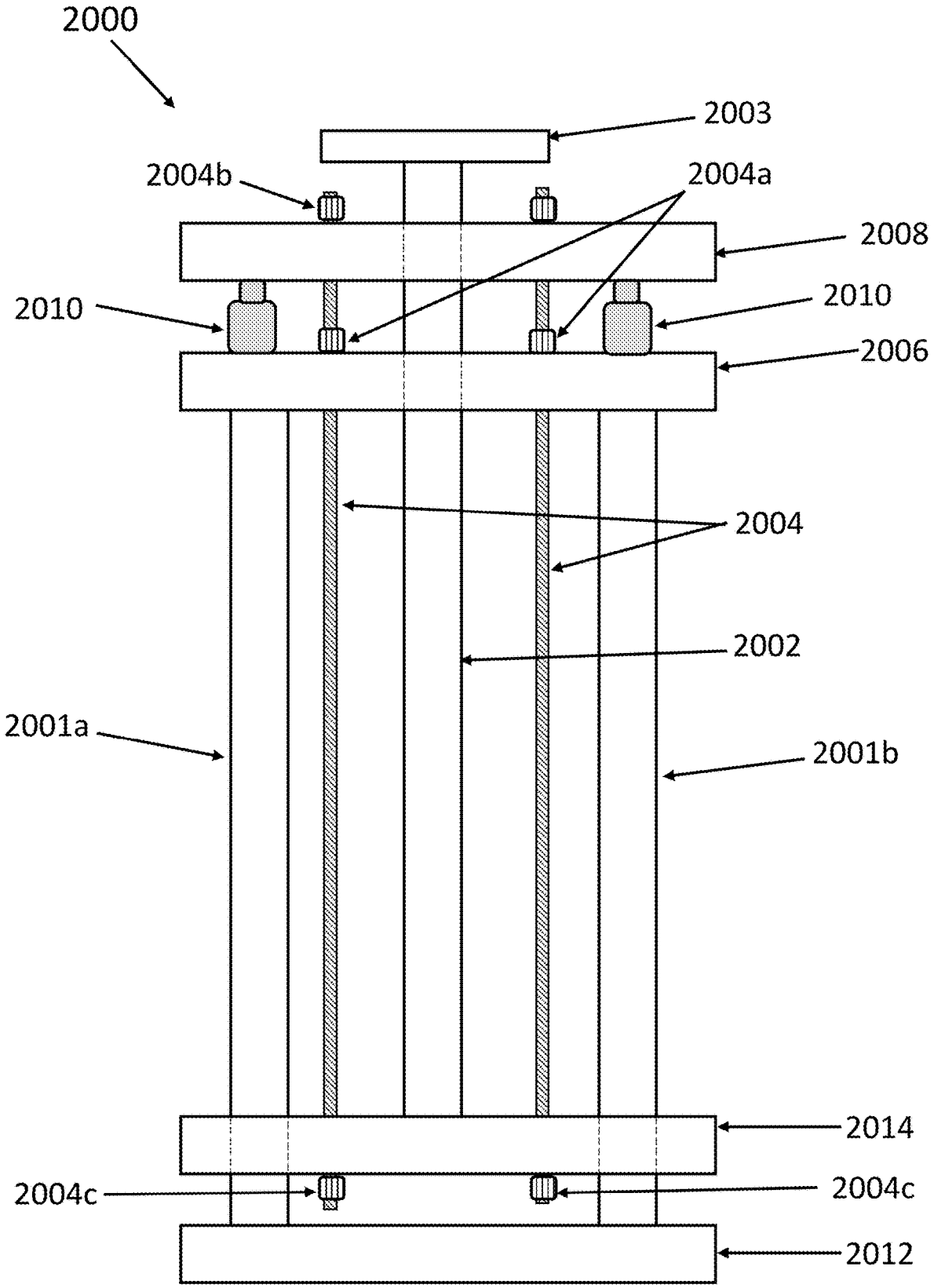
FIG. 10 illustrates an elevation view of a hydraulic lift caisson according to another example embodiment of the present inventive concept.

FIG. 10 illustrates an elevation view of a hydraulic lift caisson 2000 according to another example embodiment of the present inventive concept. In this example embodiment of the present inventive concept a pair of support columns 2001*a* and 2001*b* are fixed first at ends thereof to a top surface of a support column base plate 2012. The support column base plate 2012 is configured such that a bottom surface thereof can sit on any surface in which a building or other heavy object is to be lifted from. The pair of support columns 2001*a* and 2001*b* preferably extend in parallel from the top surface of the support column base plate 2012 and can be separated from each other by a predetermined distance. For example, the support column base plate 2012 can be rectangular in shape and a first support column 2001*a* can be fixed at one end of the support column base plate 2012 and a second support column 2001*b* can be fixed at an opposite end of the support column base plate 2012. The support column base plate 2012 can alternatively have a circular shape or any other shape which will accommodate the terrain in which the hydraulic lift caisson 2000 is required to be seated thereon. It is to be noted that more than a pair of support columns 2001 can be used in order to provide the intended purposes of the present inventive concept as described herein without departing from the spirit and scope of the overall present inventive concept.

According to this example embodiment, the support column base plate 2012 is rectangular in shape and can include the first support column 2001*a* disposed adjacent to the first end thereof and the second support column 2001*b* disposed adjacent to the second end thereof. In the alternative case where the support column base plate 2012 is square or round in shape, or any other utilitarian shape, the first and second support columns 2001*a*, 2001*b* can be disposed at different locations on the top surface of the support column base plate 2012, or more than two support columns 2001 can be disposed at different locations on the top surface of the support column base plate 2012 as may be required for heavier buildings or other objects to be lifted, or in order to accommodate different shaped terrain in which the support column base plate 2012 is to be placed thereon. In order to maintain brevity of the detailed description herein only first and second support columns 2001*a* and 2001*b* will be described herein, and therefore other components which work together with the support columns 2001*a* and 2001*b* will be described to correspond with only the pair of support columns 2001*a* and 2001*b*. However, it is to be noted that other components to be described herein can be configured to correspond with the number of support columns 2001 used in order to work together with the number of support columns being used, without departing from the spirit and scope of the overall present inventive concept as described herein.

Above and directly aligned with the support column base plate 2012 can be disposed a lifting post base plate 2014. The lifting post base plate 2014 preferably has the same shape and surface area as the support column base plate 2012 and can include holes extending therethrough which conform with the shape the support columns 2001*a* and 2001*b*, respectively, to receive a respective one of the support columns 2001*a* and 2001*b* therethrough. The lifting post base plate 2014 is configured to slide along the entire length of the support columns 2001.

Figure 11:
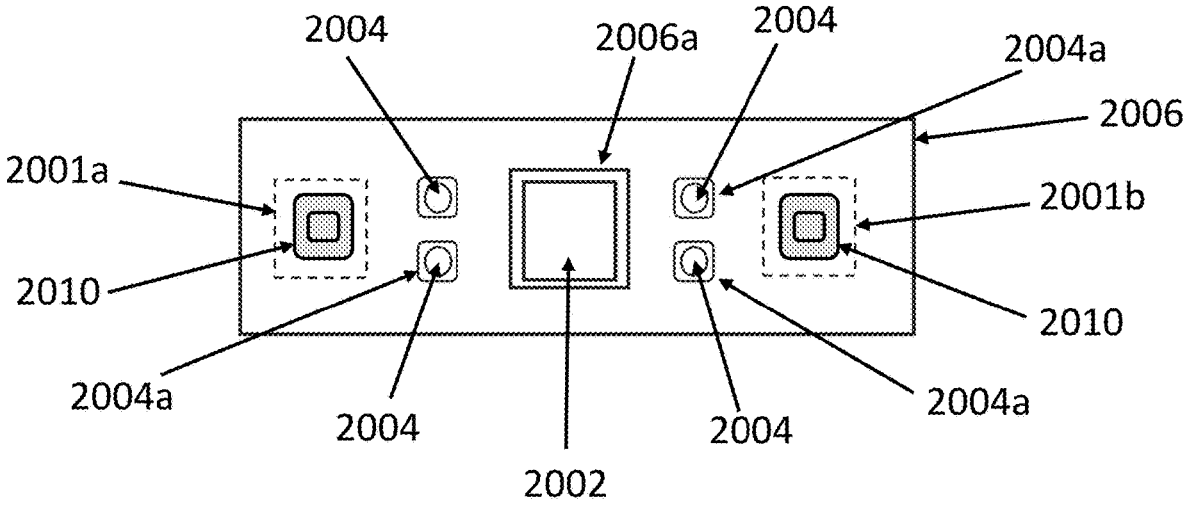
FIG. 11 illustrates a plan view of the hydraulic lift caisson according to the example embodiment of FIG. 10.

At second ends of the support columns 2001*a* and 2001*b* can be fixed an anchor plate 2006 such that the support columns 2001*a* and 2001*b* extend in parallel from the support column base plate 2012 to a bottom surface of the anchor plate 2006, wherein the lifting post base plate 2014 can slide therebetween. The lifting post base plate 2014 and the anchor plate 2006 can also include at least two rod holes extending therethrough to receive a respective threaded rod 2004 therethrough. Preferably a first one of the at least two rod holes extending through the lifting post base plate 2014 and the anchor plate 2006 is disposed adjacent to the first support column 2001*a* and a second one of the at least two holes extending through the lifting post base plate 2014 and the anchor plate 2006 is disposed adjacent to the second support column 2001*b*. However, it is to be noted that more than two rod holes can be formed through the lifting post base plate 2014 and the anchor plate 2006 to receive a corresponding threaded rod 2004 therethrough. For example, as illustrated in FIG. 11, the anchor plate 2006 and the lifting post base plate 2014 can include a pair of rod holes adjacent to the first support column 2001*a* and a pair of rod holes adjacent to the second support column 2001*b* such that four threaded rods 2004 extend through corresponding rod holes formed through both the lifting post base plate 2014 and the anchor plate 2006. It is to be noted that any number of threaded rods 2004 can be used to perform the intended purposes of the hydraulic lift caisson 2000 in order to withstand the weight of a building or other heavy object to be lifted, without departing from the spirit and scope of the overall present inventive concept as described herein.

First ends of the threaded rods 2004 extend through each respective rod hole formed through the lifting post base plate 2014. A threaded nut 2004*c* can be threaded onto a corresponding first end of the threaded rods 2004 to prevent the threaded rods 2004 from sliding out of the respective rod holes formed through the lifting post base plate 2014. Further, a threaded nut 2004*a* can be threaded onto a corresponding second end of the threaded rods 2004 to prevent the threaded rods 2004 from sliding out of the respective rod holes formed through the anchor plate 2006.

Referring back to FIG. 10, directly above the anchor plate 2006 can be disposed a jacking plate 2008. The jacking plate 2008 preferably has the same shape and surface area as the anchor plate 2006 and can include rod holes extending therethrough which align with the rod holes formed through the anchor plate 2006 to receive corresponding ones of the second ends of the threaded rods 2004 therethrough. After the threaded rods 2004 are inserted through corresponding ones of the rod holes formed through the jacking plate 2008 a threaded nut 2004*b* can be threaded onto corresponding second ends of the threaded rods 2004 to prevent the jacking plate 2008 from being lifted away from the threaded rods 2004.

A top surface of the lifting post base plate 2014 can include a lifting post 2002 fixed to a center portion thereof. The lifting post 2002 preferably extends in parallel with and between the support columns 2001*a* and 2001*b*. The lifting post 2002 is also preferably disposed between the threaded rods 2004. Both the anchor plate 2006 and the jacking plate 2008 can include a hole formed therethrough to receive the lifting post 2002 therethrough. At the top end of the lifting post 2002 can be fixed a top plate 2003. The top plate 2003 is configured to press against a bottom surface of a building or other heavy object to lift the building or other heavy object, as described in more detail below. The support columns 2001*a* and 2001*b*, the lifting post 2002, the support column base plate 2012, the lifting post base plate 2014, the anchor plate 2006, the threaded rods 2004 and the jack plate 2008 can be formed of steel, or any other metal or hard rigid material that will withstand several tons of weight.

Between the anchor plate 2006 and the jacking plate 2008 can be disposed one or more hydraulic jacks 2010. According to the present example embodiment as illustrated in FIG. 10, two hydraulic jacks 2010 are used. When the hydraulic jacks 2010 are activated to expand the jacking plate 2008 will be lifted away from the anchor plate 2006 by the force applied by the hydraulic jacks 2010 between the anchor plate 2006 and the jacking plate 2008. As a result of the jacking plate 2008 being lifted away from the anchor plate 2006 the threaded rods 2004, due to the threaded placement of the threaded nuts 2004*b* and threaded nuts 2004*c*, the threaded rods 2004 will pull the lifting post base plate 2014 and the lifting post 2002 upward along the support columns 2001*a* and 2001*b* and away from the support column base plate 2012. At the same time the top plate 2003 will move together with the lifting post 2002 to lift a building or other heavy object in which the hydraulic lift caisson 2000 is placed under.

Once the hydraulic jacks 2010 are fully expanded the threaded nuts 2004*a* can be threaded further along the respective threaded rods 2004 such that the lifting post base plate 2014 and lifting post 2002 will remain at their newly raised positions while the threaded nuts 2004*a* are seated on the top surface of the anchor plate 2006. At this point the hydraulic jacks 2010 can be released from hydraulic pressure to retract back to their original positions, which will cause the jack plate 2008 to drop down back toward the anchor plate 2006 while the lifting post base plate 2014 and lifting post 2002 remain at their newly raised positions. Once the jacking plate 2008 is dropped back to its original position with respect to the anchor plate 2006 the threaded nuts 2004*b* can be threaded further along their respective threaded rods 2004 to once again be seated on the jacking plate 2008 while the lifting post 2002 and top plate 2003 remain at their newly raised position. To further raise the lifting post 2002 and top plate 2003 the hydraulic jacks 2010 can once again be operated to expand and lift the jacking plate 2008. This process can be repeated until the lifting post 2002 and top plate 2003 are raised to a desired position, thus lifting the building or other heavy object to the desired height. The hydraulic jacks 2010 disposed on each anchor plate 2006 are configured to be operated in sync to simultaneously lift the jacking plate 2008 such that the jacking plate 2008 remains in a horizontal position while being lifted. The hydraulic jacks 2010 can lift the jacking plate 2008 slowly and in various stroke lengths.

It is to be noted that the number of support columns, threaded rods, etc., can be increased or decreased as desired to accommodate the size and weight of a building to be lifted, without departing from the spirit and scope of the overall present inventive concept.

Although a few embodiments of the present general inventive concept have been shown and described, it will be appreciated by those skilled in the art that changes may be made in these embodiments without departing from the principles and spirit of the general inventive concept, the scope of which is defined in the appended claims and their equivalents.

What is claimed is:

1. A hydraulic lift caisson to lift a building, comprising:

at least two support columns including first and second ends;

a lifting post disposed between the support columns and including first and second ends, wherein the second end is configured to be placed directly under a building or other large object to be lifted;

a support column base plate attached to the first end of each support column;

a lifting post base plate disposed above the support column base plate, the lifting post base plate having a first end of the lifting post fixed to a top surface thereof and including:

at least two support column holes to receive a corresponding one of the support columns therethrough; and at least two rod holes each to receive a threaded rod therethrough;

an anchor plate fixed to the second ends of the pair of support columns, the anchor plate including:

a lifting post hole to receive the lifting post therethrough, and at least two rod holes each to receive a threaded rod therethrough;

a jacking plate disposed directly above the anchor plate and including:

a center hole to receive the lifting post therethrough; and at least two rod holes each to receive a threaded rod therethrough;

at least two threaded lifting rods extending through respective ones of the rod holes through the lifting post base plate, the anchor plate and the jacking plate, each of the threaded rods including a lifting post base plate locking nut threaded onto a first end thereof to lock a first end of the threaded lifting rods between the support column base plate and the lifting post base plate, an anchor plate nut threaded onto each of the threaded lifting rods and disposed between the anchor plate and the jack plate, and a jacking plate nut threaded onto each of second ends of the threaded lifting rods to rest on a top surface of the jacking plate; and a plurality of hydraulic jacks disposed between the anchor plate and the jacking plate to lift the jacking plate away from the anchor plate, thus also lifting the threaded lifting rods, the lifting post base plate and the lifting post upward together with the jacking plate.

2. The hydraulic lift caisson according to claim 1, wherein the at least two support columns, the lifting post, the threaded rods, the anchor plate and the jacking plate are formed of steel.

3. The hydraulic lift caisson according to claim 1, wherein the support column base plate, the lifting post base plate, the anchor plate and the jack plate are rectangular, and the lifting post is square.

4. The hydraulic lift caisson according to claim 3, wherein:

the at least two rod holes formed through the lifting post base plate, the anchor plate and the jack plate include four holes; and the at least two threaded lifting rods include four threaded lifting rods.

5. The hydraulic lift caisson according to claim 1, wherein the plurality of hydraulic jacks includes one hydraulic jack disposed above each of the at least two support columns and between the anchor plate and the jack plate.

6. The hydraulic lift caisson according to claim 1, wherein the lifting post includes four sixteen inch sides that are each ⅝ inch thick.

7. The hydraulic lift caisson according to claim 1, wherein the anchor plate and the jacking plate are four inches thick.

8. The hydraulic lift caisson according to claim 1, wherein the at least two support columns and the lifting post are at least 10 feet in length.

9. A hydraulic lift caisson to lift large heavy objects, comprising:

a support column base plate including two parallel support columns fixed at first ends thereof to a top surface of the support column base plate;

a lifting post base plate disposed directly above the support column base plate, the lifting post base plate including:

two support column holes each to receive a respective one of the support columns therethrough;

a lifting post extending from a top surface thereof and disposed between the two support column holes; and first and second pairs of rod holes extending therethrough, the first pair of rod holes disposed between one support column and the lifting post and the second pair of rod holes disposed between the other support column and the lifting post;

an anchor plate fixed to second ends of the two support columns, the anchor plate including:

a lifting post hole to receive the lifting post therethrough, and first and second pairs of rod holes axially aligned with the first and second pairs of rod holes extending through the lifting post base plate;

a jacking plate disposed directly above the anchor plate and including:

a center hole to receive the lifting post therethrough; and two pairs of rod holes axially aligned with the first and second pairs of rod holes extending through the lifting post base plate and the anchor plate;

two pairs of threaded lifting rods extending through each of the two pairs of rod holes extending through the lifting post base plate, the anchor plate and the jacking plate, each of the threaded rods including a lifting post base plate locking nut threaded onto a first end thereof to lock a first end of the threaded lifting rods between the support column base plate and the lifting post base plate, an anchor plate nut threaded onto each of the threaded lifting rods between the anchor plate and the jack plate, and a jacking plate nut threaded onto each of second ends of the threaded lifting rods to rest on a top surface of the jacking plate; and at least one hydraulic jack disposed between the anchor plate and the jacking plate to lift the jacking plate away from the anchor plate, thus also lifting the threaded lifting rods, the lifting post base plate and the lifting post upward together.

10. The hydraulic lift caisson according to claim 9, wherein the two support columns, the lifting post, the threaded rods, the anchor plate and the jacking plate are formed of steel.

11. The hydraulic lift caisson according to claim 9, wherein the support column base plate, the lifting post base plate, the anchor plate and the jack plate are rectangular, and the lifting post is square.

12. The hydraulic lift caisson according to claim 9, wherein the at least one hydraulic jack includes one hydraulic jack disposed at each of two sides of the lifting post.

* * * * *